United States Patent [19]

Kimberlin

[11] Patent Number: 4,917,569

[45] Date of Patent: Apr. 17, 1990

[54] TURBINE CONTAINMENT SYSTEM

[75] Inventor: Robert R. Kimberlin, Athens, Pa.

[73] Assignee: Ingersoll-Rand Company, Woodcliff Lake, N.J.

[21] Appl. No.: 266,656

[22] Filed: Nov. 3, 1988

[51] Int. Cl.[4] ..... F01D 5/06; F01D 9/02

[52] U.S. Cl. ..... 415/84; 415/83; 415/187; 415/188

[58] Field of Search ..... 415/9, 83, 84, 87, 187, 415/188, 196

[56] References Cited

U.S. PATENT DOCUMENTS

| | | | |
|---|---|---|---|
| 797,058 | 8/1905 | Hedlund | 415/196 |
| 823,526 | 6/1906 | Hachenberg | 415/87 |
| 995,803 | 6/1911 | Patsctke | 415/187 X |
| 1,208,762 | 12/1916 | Eklund | 415/87 |
| 3,241,813 | 3/1966 | Von Flue et al. | 415/9 |
| 3,369,737 | 2/1968 | Switzer et al. | 415/87 |
| 4,639,188 | 1/1987 | Swadley | 415/9 |

FOREIGN PATENT DOCUMENTS

| | | | |
|---|---|---|---|
| 581120 | 11/1924 | France | 415/87 |

*Primary Examiner*—Robert E. Garrett
*Assistant Examiner*—Hoang Nguyen
*Attorney, Agent, or Firm*—Walter C. Vliet; Arthur N. Trausch, III

[57] ABSTRACT

A containment system for a radial flow turbine assembly includes a housing assembly, and a turbine rotor journalled for rotation about an axis and having a hub portion and a generally tapering disc portion extending radially outward from the hub portion. An annular nozzle assembly normally secured in the housing assembly against rotation forms a tapered rotor chamber within which the rotor rotates with minimum axial and radial clearance between the rotor and the chamber. A plurality of support struts extend axially inward from the nozzle assembly to a minimal axial and radial clearance with the hub portion of the rotor and forms a first stage of containment. The rotor must first break through the nozzle struts and separate the nozzle assembly. A rotatable nozzle assembly then absorbs some of the force by rotating in the housing assembly and containment ring. An armored containment ring stops the fragments that escape the nozzle assembly and finally, an outer housing provides still further containment.

7 Claims, 1 Drawing Sheet

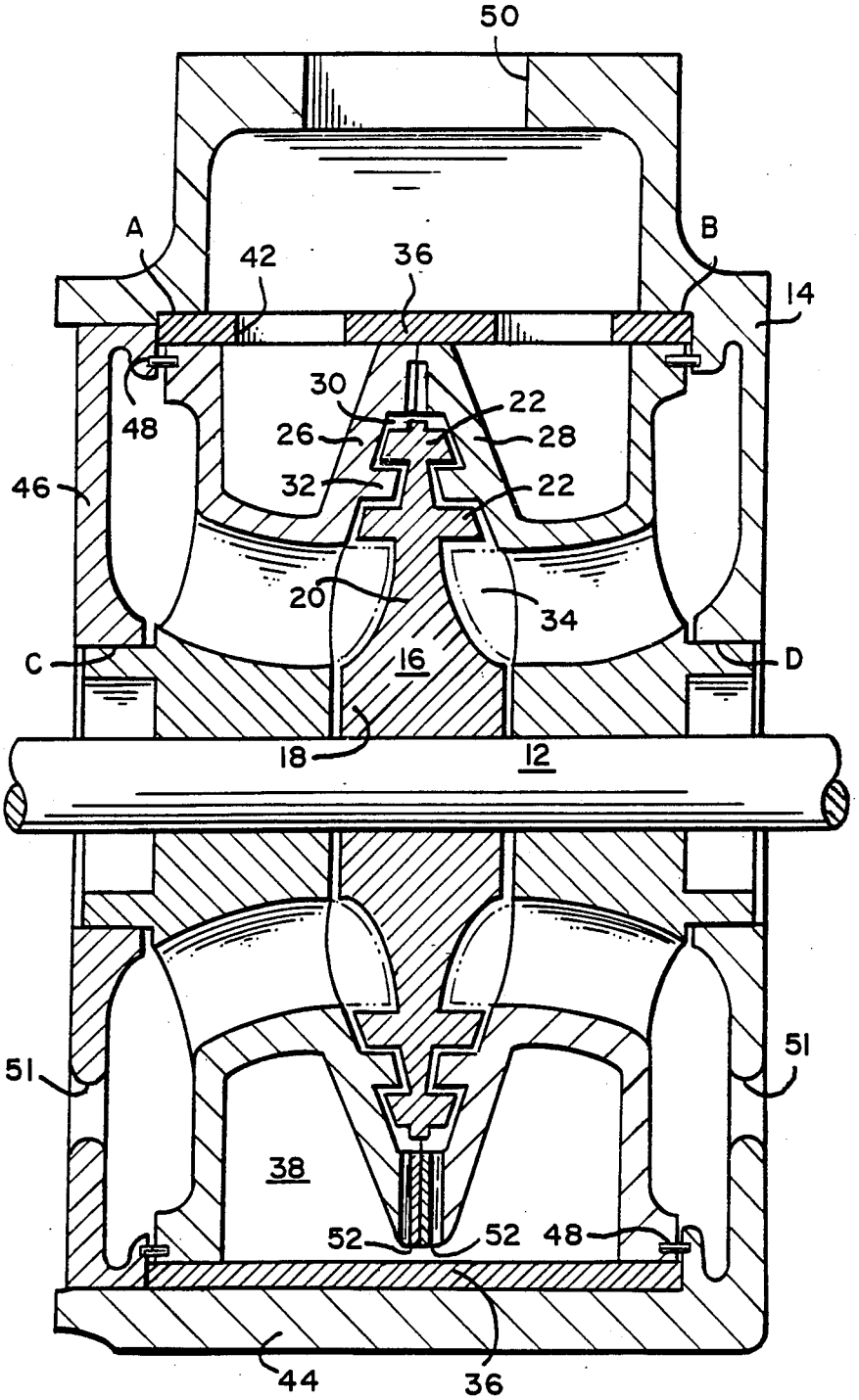
50
A
B
42
36
14
30
22
26
28
48
32
22
46
20
34
C
16
D
18
12
51
51
38
52
52
48
44
36

TURBINE CONTAINMENT SYSTEM

FIELD OF THE INVENTION

This invention relates to a turbine containment system for containing a rotor burst during uncontrolled operation of a radial flow turbine.

BACKGROUND OF THE INVENTION

Turbine drive units are designed to operate at speeds above 50,000 RPM. At excess speeds, however, there is the ever present danger that the turbine rotor may break apart and be thrown radially out of the turbine mechanism due to centrifugal force. Any number of circumstances may cause excessive and uncontrollable speed in a turbine mechanism. At speeds exceeding the rotor burst speed, excessive centrifugal forces may cause the rotor to break up due to exceeding stress limits or the limits of material integrity. Typically containment for a turbine has consisted of a heavy and hopefully impenetrable armored ring circumferentially surrounding the most likely radial path of a rotor burst. This ring typically adds weight and size to the turbine mechanism but may not necessarily stop escaping high energy rotor fragments.

SUMMARY OF THE INVENTION

It is a primary object of this invention to provide a turbine containment system that is reliable but not excessive in size or weight.

It is another object of this invention to provide a turbine containment system that will disable a fractured rotor in a benign manner.

In general the foregoing objects are obtained in a turbine mechanism wherein the radially outward trajectory of a broken turbine rotor is into a nozzle assembly. The rotor hub will contact the axially extending struts. The turbine nozzles will provide further breaking action as the turbine rotor disk and blades sever the nozzles. A second element of the system is providing a nozzle assembly that is rotatable inside the turbine housing so as to absorb some of the centrifugal force of a broken rotor and convert it into rotational motion inside the turbine. A third element of the containment system is an armored containment ring. A fourth element of the system is an additional shroud near the outside of the housing assembly.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 1 is a schematic sectional view of a radial flow turbine mechanism showing the various elements of the containment system of the present invention.

DESCRIPTION OF THE PREFERRED EMBODIMENT

Referring now to the drawing, the assembly and operation of the present invention will now be described. A rotor shaft 12 is journalled for rotation in a housing assembly generally shown by 14. A turbine rotor member 16 is attached at a thick hub portion 18 to the shaft 12 by a known method such as press fit for example, for rotation therewith. A disk portion 20 extends radially outward from the hub portion. The two opposed surfaces of the disk portion converge or taper to an outer circumferential surface. A plurality of axially extending turbine blades 22 are cantilevered on the turbine rotor disk portion. Two stages of blades are shown.

Two mirror-image nozzle members 26 and 28 are assembled together into an annular nozzle assembly. A rotor chamber 30 is formed around the rotor 16 by the interior of the nozzle assembly. The rotor chamber converges or tapers as it extends radially outward in general compliance with the profile of the turbine rotor disk portion 20. Axially inward extending stator nozzles 32 are circumferentially positioned radially adjacent the axially outward extending turbine blades 22. Circumferentially spaced and axially inward extending struts 34 extend from the nozzle members to a position adjacent the hub portion 18. Minimal axial and radial clearances are provided between the rotating rotor and the stationary nozzle assembly.

An annular containment ring 36 is fitted and properly orientated in the housing assembly 14. The containment ring is constructed of a hardened material such as steel. The containment ring also helps form the plenum chamber 38 for pressurized motive fluid. Thus the armored ring is not an additional and superfluous part that adds additional weight and size. Inlet ports 42 into the plenum chamber are axially offset from the radial burst line of the rotor.

An outer shroud 44 radially outward of the containment ring is provided by the inlet and the exhaust passageways in the housing assembly 14.

The annular nozzle assembly 26 and 28 is located in the housing assembly 14 by a pilot fit with the containment ring 36 at annular contact points A and B. The nozzle assembly is further located with respect to the housing assembly 14 with a pilot fit at annular contact points C and D. A housing member 46 is secured to the housing assembly so as to provide a small axial clamp force on the nozzle assembly. The clamp force is sufficient to prevent rotation of the nozzle assembly during non-operation of the turbine. Additional clamp force between the nozzle assembly 26 and 28 and the housing assembly 14 is provide during normal operation of the turbine when pressurized motive fluid is introduced into the plenum chamber 38. This forces the nozzle members 26 and 28 outward against the housing assembly 14 and increases the clamp force.

The fit of the nozzle housing assembly in the containment ring 36 is sufficiently loaded to transmit power generated by the motor during operation. In a non-operating mode, the nozzle assembly is lightly preloaded to prevent free movement but will rotate within the housing when force greater than the preload is applied, such as a burst impact of a rotor. This will allow rotation of the nozzle assembly 26 and 28 within both the housing assembly 14 and containment ring 36 when rotation is initiated by a predetermined minimum impact torque.

In operation, pressure fluid enters the turbine through inlet 50 into inlet plenum chamber 38 and through inlet ports 42. The pressure fluid then passes through the inlet nozzles 52, past the turbine blades 22 where power is extracted and imparted to the turbine wheel or rotor 16. The spent pressure fluid is then exhausted through horizizontal ports formed by the struts 34 into exhaust plenum 53 and finally exhausted through exhaust ports 51 formed in the housing 14. If a high speed failure of the turbine rotor occurs, the hub section 18 must first impact the nozzle assembly struts 34 that are directly in the burst path. This will happen immediately after burst due to the close clearance between the rotor and nozzle assembly. The impact of the burst rotor will begin translating the kinetic energy to the nozzle assembly in the direction of rotation. The wedge shape of the turbine rotor 16 will also initially begin to split the nozzle assembly 26 and 28 apart.

The burst rotor will also have a rotational component to its centrifugal force. The impact of any rotor fragment moving by centrifugal force will cause the nozzle assembly 26 and 28 to rotate within the housing assembly 14 and containment ring 36 due to the loose pilot fit at contact points A-C and B-D respectively previously described.

Optionally, pins 48 may be used to properly orientate the nozzle assembly to the housing assembly. The pins can be easily severed by a torque spike on the nozzle assembly, such as caused by a rotor fragment impact. During normal steady operation of the turbine, the axial load due to the pressure in the plenum chamber 38 reduces the torque load transmitted to the pins.

The kinetic energy of a burst rotor will be reduced by the ability of the nozzle assembly 26 and 28 to rotate within the housing assembly and containment ring. This reduction in energy of the burst rotor will allow easier containment of fragments by the containment ring 36 and the outer shroud housing 44 if necessary.

The containment system thus consists of four stages: the rotor must first break through the nozzle assembly struts and separate the nozzle assembly; the rotatable nozzle assembly then absorbs some of the force by rotating in the housing assembly and containment ring; the armored containment ring stops any fragments that escape the nozzle housing; and finally the outer housing provides still further containment.

While the present invention has been disclosed in connection with the preferred embodiment thereof, it should be understood that there are many other embodiments which fall within the spirit and scope of the invention as defined by the following claims:

I claim:

1. A containment system for a radial-flow turbine assembly comprising:

a housing assembly;

a turbine rotor journalled for rotation about an axis and having a hub portion and a generally tapering disk portion extending radially outward from the hub portion;

an annular nozzle assembly adapted for rotation within said housing assembly and normally secured in the housing assembly against rotation and forming a tapered rotor chamber within which the rotor rotates with minimum axial and radial clearance between rotor and chamber;

a plurality of support struts extending axially inward from the nozzle assembly to a minimal axial and radial clearance with the hub portion of the rotor; and a containment ring having an inner diameter surface securing the outer annular surface of the nozzle assembly so that the nozzle assembly can be rotated relative to the containment ring in preselected situations.

2. The system of claim 1 wherein the nozzle assembly is secured in the housing assembly by an axial clamp force produced by the housing assembly and by the outward clamp force of the nozzle assembly produced by the fluid pressure in the rotor chamber during normal operation of the turbine.

3. The system of claim 2 further including pins securing the nozzle assembly to the housing assembly, said pins capable of being sheared by a preselected torque force on the nozzle assembly.

4. The system of claim 2 further including an outer shroud formed by an exhaust passageway in said housing assembly.

5. The system of claim 1 wherein the nozzle assembly is secured in the ring by a pilot fit.

6. The system of claim 1 wherein the containment ring comprises a substantially impenetrable material.

7. The system of claim 1 wherein one preselected situation is a torque impact by a broken rotor on the nozzle assembly.

* * * * *